US006424317B2

(12) United States Patent
Rudish

(10) Patent No.: US 6,424,317 B2
(45) **Date of Patent: *Jul. 23, 2002**

(54) HIGH EFFICIENCY BROADBAND ANTENNA

(75) Inventor: Ronald M. Rudish, Commack, NY (US)

(73) Assignee: AIL Systems, Inc., Deer Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/832,628

(22) Filed: Apr. 11, 2001

Related U.S. Application Data

(63) Continuation of application No. 09/251,162, filed on Feb. 17, 1999, now Pat. No. 6,219,006.

(51) Int. Cl.[7] ..... H01Q 1/36; H01Q 1/38

(52) U.S. Cl. ..... 343/895; 343/700 MS; 343/792.5

(58) Field of Search ..... 343/895, 700 MS, 343/792.5; H01Q 1/36, 1/38

(56) References Cited

U.S. PATENT DOCUMENTS

| | | | |
|---|---|---|---|
| 4,658,262 A | 4/1987 | DuHamel | 343/895 |
| 5,386,215 A | 1/1995 | Brown | 343/795 |
| 5,541,613 A | 7/1996 | Lam et al. | 343/792.5 |
| 5,739,796 A | 4/1998 | Jasper, Jr. et al. | 343/895 |
| 5,990,850 A | 11/1999 | Brown et al. | 343/912 |
| 6,219,006 B1 * | 4/2001 | Rudish | 343/895 |

OTHER PUBLICATIONS

H. Y. D. Yang, N.G. Alexopoulos and E. Yablonovitch, *Photonic Band–Gap Materials for High Gain Printed Circuit Antennas*, IEEE Transactions on Antennas and Propagation, vol. 45, No. 1 (Jan. 1997).

E. Yablonovitch and T. J. Gmitter, *Photonic Band Structure: The Face–Centered Cube Case*, J. Opt. Soc. Am. B., vol. 7, No. 9 (Sep. 1990).

E. Yablonovitch, T.J. Gmitter and K.M. Leung, *Photonic Band Structure: The Face–Centered–Cubic Case Employing Nonspherical Atoms*, Physical Review Letters—The American Physical Society, vol. 67, No. 17 (Oct. 21, 1991).

(List continued on next page.)

*Primary Examiner*—Hoanganh Le
(74) *Attorney, Agent, or Firm*—Hoffmann & Baron, LLP

(57) ABSTRACT

An antenna includes at least two planar conductors cooperatingly arranged in a planar configuration having a bifilar spiral winding structure, a log-periodic structure or a sinuous configuration and a frequency-independent reflective backing situated on one axial side of the planar configuration. The backing includes a solid, disk-shaped dielectric substrate having a relatively high dielectric constant, and three mutually perpendicular arrays of elongated dielectric elements at least partially embedded in the solid dielectric substrate. The elongated dielectric elements have a relatively low dielectric constant. The elongated dielectric elements of the three mutually perpendicular arrays are formed as rods, cones and rings.

20 Claims, 3 Drawing Sheets

OTHER PUBLICATIONS

E. R. Brown, C.D. Parker and E. Yablonovitch, *Radiation Properties of a Planar Antenna on a Photonic–Crystal Substrate*, J. Opt. Soc. Am. B., vol. 10, No. 2 (Feb. 1993).

E. Yablonovitch, *Inhibited Spontaneous Emission in Solid–State Physics and Electronics*, Physical Review Letters—The American Physical Society, vol. 58, No. 20 (May 18, 1987).

R. E. Franks and C.T. Elfving, *Reflector–Type Periodic Broadband Antennas*, 1958 IRE WESCON Convention Record, pp. 266–271.

D. A. Hofer, Dr. O.B. Kesler and L. L. Lovet, *A Compact Multi–Polarized Broadband Antenna*, IEEE Antennas & Propagation Symposium Digest, vol. 1, pp. 522–525 (1990).

V. K. Tripp and J. J. H. Wang, *The Sinuous Microstrip Antenna*, IEEE Antennas & Propagation Symposium Digest, pp. 52–55 (1991).

P. Asbeck, J. Mink, T. Itoh and G. Haddad, *Device and Circuit Approaches for Next–Generation Wireless Communications*, Microwave Journal, pp. 28–42 (1999).

* cited by examiner

HIGH EFFICIENCY BROADBAND ANTENNA

This application is a continuation of application Ser. No. 09/251,162, filed on Feb. 17, 1999, now U.S. Pat. No. 6,219,006.

BACKGROUND OF THE INVENTION

1. Field of the Invention

This invention relates generally to antennas that exhibit wide bandwidth and wide beamwidth, and more specifically relates to wideband planar antennas. Even more particularly, the present invention relates to multi-octave bandwidth spiral antennas, log-periodic antennas and sinuous antennas.

2. Description of the Prior Art

The multi-octave bandwidth spiral antenna is a preferred antenna-type for Electronic Warfare Support Measures (ESM) and ELectronic INTelligence (ELINT) radar systems. The reasons for choosing a spiral antenna over others are that its wide bandwidth offers a high probability of intercept, and its wide beamwidth is well matched to either the field-of-view requirements of a wide-angle system or to the included angle of a reflector in a narrow field-of-view system. Nevertheless, the spiral antenna does have a significant fault; its efficiency is less than fifty percent since it invariably depends on an absorber-filled back cavity for unidirectionality.

The conventional, planar, two-arm, spiral antenna comprises two planar conductors that are wound in a planar, bifilar fashion from a central termination. At the center of the spiral antenna, a balanced transmission line is connected to the arms of the antenna and projects at right angles to the plane of the spiral. The conductive arms of the spiral antenna are wound outwardly in the form of either an Archimedes or equiangular spiral. Stated differently, the radial position of either winding is linearly proportional to the winding angle, or its logarithm in the case of the equiangular spiral antenna.

The spiral antenna is typically used as a receiving antenna. However, the operation of the spiral antenna is more easily explained by considering the spiral antenna as a transmitting antenna. A balanced excitation applied to the central transmission line induces equal, but oppositely-phased, currents in the two conductive arms near the center of the spiral. The two currents independently progress outwardly following the paths of their respective conductive arms. Eventually, the currents progress to the section of the spiral that is approximately one free-space wavelength in circumference. In this section, the differential phase shift has progressed to 180 degrees so that the adjacent conductor currents which started in opposition are now fully in phase. Furthermore, the currents in diametrically opposing arc sections of the spiral antenna are now co-directed because of a phase reversal, which enables strong, efficient broadside radiation from these currents.

The region of efficient radiation of the spiral antenna scales in physical diameter with operating wavelength. Thus, a spiral antenna comprising many windings (i.e., greater physical diameter) has a large bandwidth. The spiral antenna radiates efficiently in both forward and backward directions normal to its plane. If only forward coverage is desired, then the backward radiation is wasted, resulting in a 3 dB decrease in efficiency, and a directive gain of only about 2 dBi.

In addition to the loss in efficiency, portions of the backward radiation can also be reflected or scattered forward by structures behind the spiral antenna. This forward-scattered radiation interacts with the directly-forward radiation to cause scalloping of the forward pattern. Thus, in those cases where the spiral antenna must be located in front of other structures, the spiral winding is typically backed by a microwave absorber within a metallic cavity. The microwave absorber and the metallic cavity increase shielding and provide environmental protection.

Previous attempts to render the spiral unidirectional without this 3 dB loss resulted in limiting its bandwidth. For example, by removing the absorber and retaining the cavity (or including a rear ground plane), the gain is increased to approximately 5 dB. However, this reduces the bandwidth to less than an octave, even if the spiral is optimally spaced from the back wall of the cavity. In one method to achieve wider bandwidth without the absorber lining, the spiral-to-backwall spacing is increased with spiral radius so that the spacing is optimal in the radiating region (i.e., where the windings are one wavelength in circumference), regardless of the frequency. In other words, the back wall is conically concave in shape. This method is not fully acceptable because a substantial portion of the backward radiated signal propagates radially outward from the sloping cavity backwall, until it is reflected by the cavity sidewalls.

A microstrip version of the spiral antenna was also attempted. This structure is distinguished by its use of material with a high dielectric constant and low loss to fill the space between the spiral antenna and the cavity backwall. This structure also fails to achieve a greater-than-octave bandwidth since most of the radiation is directed into the substrate rather than into the air, and much of the substrate signal is trapped in the radial propagation of a surface wave.

OBJECTS AND SUMMARY OF THE INVENTION

It is an object of the present invention to provide a high efficiency broadband antenna.

It is another object of the present invention to provide a unidirectional spiral antenna with increased efficiency and concomitant receiving sensitivity.

It is yet another object of the present invention to provide a log-periodic antenna with increased efficiency and concomitant receiving sensitivity.

It is still another object of the present invention to provide a sinuous antenna with increased efficiency and concomitant receiver sensitivity.

It is a further object of the present invention to provide a spiral antenna having unidirectional characteristics, which overcomes the inherent disadvantages of known unidirectional spiral antennas.

In accordance with one form of the present invention, a high efficiency broadband antenna includes at least two substantially planar conductors cooperatingly arranged in a substantially planar configuration of a bifilar spiral winding a structure, a log-periodic structure or a sinuous structure and a frequency-independent reflective backing situated on an axial side of the spiral winding. The frequency-independent reflective backing includes a radially scaled, photonic crystal-like, quasi-periodic dielectric structure.

The quasi-periodic dielectric structure preferably includes a solid dielectric substrate having a predetermined dielectric constant, and three mutually perpendicular arrays of elongated dielectric elements. The elongated dielectric elements are at least partially embedded in the solid dielectric substrate. The elongated dielectric elements have a predetermined dielectric constant which is less than that of the solid dielectric substrate.

The substrate is preferably formed as a solid disk exhibiting a high dielectric constant in which are at least partially embedded the three mutually perpendicular arrays of low dielectric constant material in the form of rods, cones and rings. The dielectric rods extend axially through the disk-shaped solid substrate and are arranged side-by-side in radial planes extending through the substrate. The cones extend radially through the substrate and are positioned between the side-by-side radial rows of rods. The rings are concentrically arranged and reside in a plane extending radially outwardly from the center of the disk-shaped substrate.

The substantially planar configuration is preferably formed by etching the winding, log-periodic or sinuous structure on copper clad Kapton™ or Mylar™ material. The copper clad material is affixed or bonded to the disk-shaped solid dielectric substrate. The substrate is formed from a high dielectric constant material and can be molded to a desired shape. The rods, cones and rings are added in the green state (i.e., before sintering) of the higher dielectric constant substrate.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
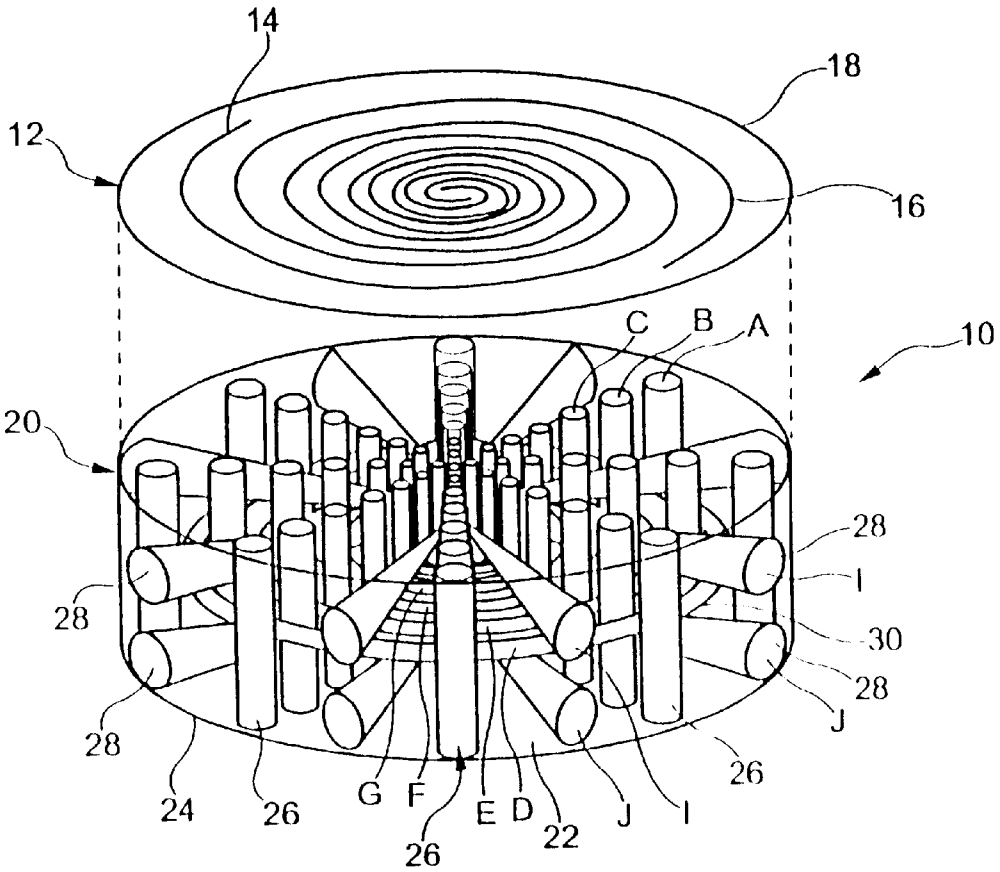
FIG. 1 is a partially exploded view of one embodiment of a high efficiency broadband antenna of the present invention.
Figure 2:
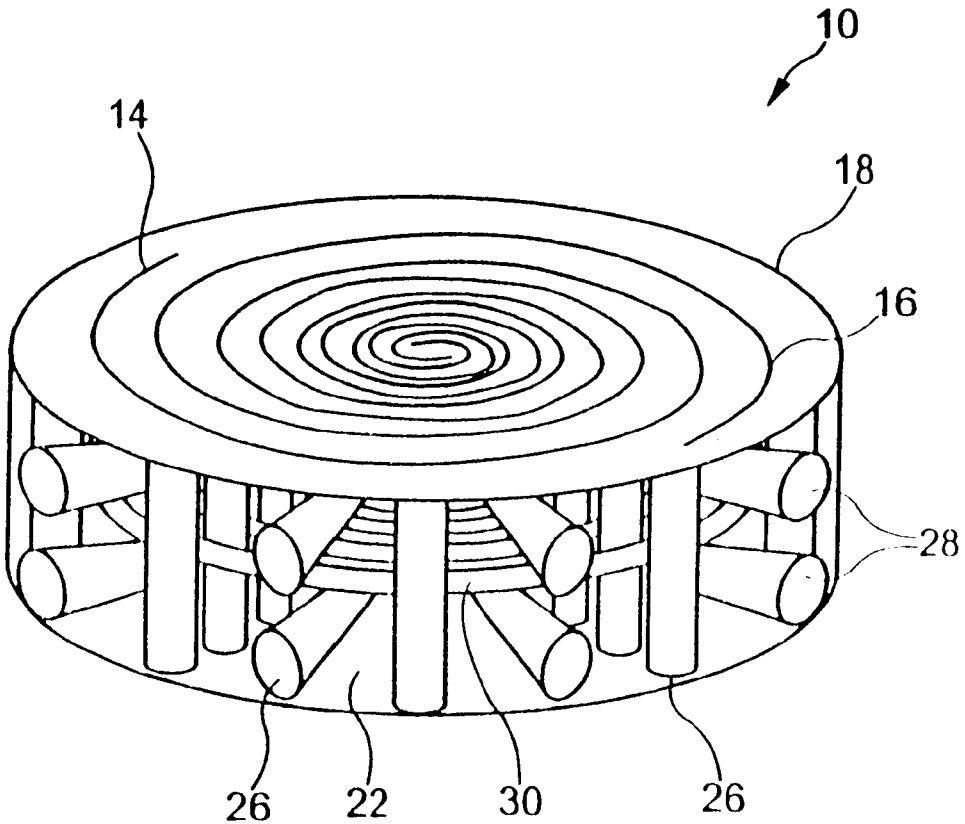
FIG. 2 is an assembled view of the high efficiency broadband antenna of FIG. 1 shown with a cylindrical housing partially removed and a spiral winding.

Referring to FIGS. 1 and 2 of the drawings, it will be seen that a high efficiency broadband antenna 10, constructed in accordance with the present invention, preferably comprises a unidirectional spiral antenna or spiral winding 12. The high efficiency broadband antenna 10 is the antenna of choice for ESM and ELINT systems. The spiral antenna 10 is multi-octave in bandwidth, which offers a high probability of intercept. The spiral antenna 10 also exhibits a wide beamwidth, which fulfills the field-of-view requirements of a wide-angle system.

In accordance with the present invention, the unidirectional spiral antenna 10 includes at least two planar conductors 14, 16, which are cooperatingly arranged in a substantially planar, bifilar spiral winding 12. The two planar conductors 14, 16 may be wound in an equiangular or Archimedean spiral as is well known in the art. Preferably, the planar conductors 14, 16 are etched on a thin copper clad kapton™ or Mylar™ material 18, which is preferably approximately two mils in thickness.

The high efficiency broadband antenna 10 of the present invention also includes a substantially frequency-independent reflective backing 20 situated on one axial side of the spiral winding 12. The reflective backing 20 includes a photonic crystal-like, quasi-periodic dielectric structure whose elements are scaled in radial dimension to the spiral winding of the planar conductors. Stated another way, the reflective backing 20 is formed as dielectric exhibiting propagation band-stop properties which scale in band-stop frequencies inversely with the radius of the spiral winding 12.

Photonic band-gap (PBG) materials are analogous to a semiconductor crystal which has electron band gaps. Band gaps are energy levels which are not occupied by electrons. A PBG material or photonic crystal is an artificial material made of periodic implants within a surrounding medium. Electromagnetic wave propagation through such a medium is affected by the scattering and diffraction properties of the periodic implants creating frequency "stop bands" in which wave propagation is blocked. The photonic crystal, as a substrate material for planar antennas, results in an antenna that radiates predominantly into the air rather than into the substrate. This is particularly true where the driving frequency of the antenna lies within the stop band of the photonic crystal, since at every point along the conductor-substrate interface there is substantially no propagation over a full hemisphere on the substrate side. Greater detail regarding photonic crystals and their properties and characteristics when used as a substrate for antennas is found in the following references, which are hereby incorporated by reference in their entirety:

1. H. Y. D. Yang, N. G. Alexopoulos, E. Yablonovitch, *Photonic Band-Gap Materials for High Gain Printed Circuit Antennas*, IEEE Transactions on Antennas and Propagation, Vol. 45, No. 1 (January 1997);
2. E. Yablonovitch, T. J. Gmitter, *Photonic Band Structure: The Force-Centered Cube Case*, J. Opt. Soc. Am. B., Vol. 7, No. 9 (September 1990);
3. E. Yablonovitch, T. J. Gmitter, K. M. Levine, *Photonic Band Structure: The Face Centered-Cubic Case Employing Non-Spherical Atoms*, Physical Review Letters—The American Physical Society, Vol, 67, No. 17 (Oct. 21, 1991);
4. E. R. Brown, C. D. Parker, E. Yablonovitch, *Radiation Properties of a Planar Antenna on a Photonic-Crystal Structure*, J. Opt. Soc. Am. B., Vol. 10, No. 2 (February 1993);
5. E. Yablonovitch, *Inhibited Spontaneous Emission in Solid-State Physics and Electronics*, Physical Review Letters—The American Physical Society, Vol. 58, No. 20 (May 18, 1987);
6. E. R. Brown, *Millimeter-Wave Applications of Photon Crystals*, Workshop on Photonic Bandgap Structures, sponsored by the U.S. Army Research Office (Jan. 28–30, 1992);
7. S. John, *Strong Localization of Photons in Certain Disordered Dielectric Superlattices*, Physical Review Letters—The American Physical Society, Vol. 58, pp. 2486–2489 (1987);
8. E. Yablonovitch, *Photonic Band-Gap Structures*, J. Opt. Soc. Amer. B., Vol. 10, No. 2,pp. 283–294 (February 1993);
9. T. Suzuki, P. L. Yu, *Experimental and Theoretical Study of Dipole Emission in the Two-Dimensional Photonic Bond Structures of the Square Lattice with Dielectric Cylinders*, Journal of Applied Physics, Vol. 79, No. 2, pp. 582–594 (January 1996);
10. N. G. Alexopoulos and D. R. Jackson, *Gain Enhancement Methods for Printed Circuit Antennas*, IEEE Transactions on Antennas and Propagation, Vol. AP-33, pp 976–987 (September 1985);

11. H. Y. Yang and N. G. Alexopoulos, *Gain Enhancement Methods For Printed Circuit Antennas Through Multiple Substrates*, IEEE Transactions on Antennas and Propagation, Vol. AP-35, pp. 860–863 (July 1987);

12. D. R. Jackson, A. A. Oliner and A. Ip, *Leaky-wave Propagation and Radiation for a Narrow-Beam Multilayer Dielectric Structure*, IEEE Transactions on Antennas and Propagation, Vol. 41, pp. 344–348 (March 1993);

13. H. Y. D. Yang, *Three-dimensional Integral Equation Analysis of Guided and Leaky Waves on a Thin-Film Structure With Two-Dimensional Material Gratings*, presented at IEEE Int. Microwave Symp. Dig., San Francisco, Calif., pp. 723–726 (June 1996);

14. H. Y. D. Yang, *Characteristics of Guides and Leaky Waves on a Thin-film Structure with Planar Material Gratings*, IEEE Transactions on Microwave Theory Tech., to be published; and 15. H. Y. D. Yang, N. G. Alexopoulos and R. Diaz, *Reflection and Transmission of Waves from Artificial-Material Layers Made of Periodic Material Blocks*, presented at IEEE Int. Symp. Antennas Propagat. Dig., Baltimore, Md. (July 1996).

As seen in FIGS. 1 and 2, the quasi-periodic dielectric structure or reflective backing 20 preferably includes a solid dielectric substrate 22 formed as a disk, which is situated on one side of the spiral winding 12 and, preferably, inside a cavity defined by the cylindrical housing 24 of the high efficiency broadband antenna 10. The solid dielectric substrate 22 has a predetermined dielectric constant, which is relatively high. The dielectric constant of the solid dielectric substrate 22 is preferably about 10 and, even more preferably, even greater so that spacings in the periodic structure can both appear microscopic to the radiating element and yet be commensurate with the wavelength within the dielectric in order to enhance Bragg scattering within it. Alumina, comprising a dielectric constant near 10, is a ceramic commonly used as a substrate for microwave integrated circuits and preferable for use in forming the solid dielectric substrate 22. An even more preferred material for forming the solid dielectric substrate 22, having a dielectric constant of 38, is the ceramic designated as S8500, which is sold by Transtech Corporation, 5520 Adamstown Road, Adamstown, Md. 21710. S8500 is a temperature compensated stabilized dielectric microwave substrate. The solid dielectric substrate 22 may be molded to the desired shape and dimensions.

The reflective backing 20 also includes three mutually perpendicular arrays of elongated dielectric elements. The dielectric elements of the arrays are at least partially embedded in the solid dielectric substrate 22. The elongated dielectric elements also have a predetermined dielectric constant, which is relatively low, and which is preferably much less than that of the solid dielectric substrate to provide sufficient scattering. More specifically, the dielectric constant of the three elongated dielectric elements is preferably between about 1 and about 2. Also, with this lower dielectric constant, the elongated dielectric elements should be able to withstand relatively high temperatures if the composite backing material is formed by sintering. One example of such a material is a ceramic foam manufactured by Owens Corning Corporation, Corning, N.Y. 14830, or a glass foam manufactured by Pittsburgh Corning Corporation, 800 Presque Isle Drive, Pittsburgh, Pa. 15239.

Referring again to FIGS. 1 and 2, the preferred form of the elongated dielectric elements of the three mutually perpendicular arrays will now be described. The first array includes a plurality of first elongated dielectric elements in the form of rods 26. These rods 26 are arranged in a plurality of planes extending substantially radially through the solid dielectric substrate 22, outwardly from the center of the substrate 22. The center of the solid dielectric substrate 22 is preferably situated substantially co-axially with the center of the spiral winding 12.

Adjacent planes in which the rods 26 reside diverge outwardly through the solid dielectric substrate 22 at a predetermined angle $\alpha$. Stated differently, adjacent planes of rods 26 are offset from one another at angle $\alpha$. The rods 26 of any respective plane are disposed substantially in parallel and spaced apart from one another in a side-by-side arrangement. Each rod 26 has a substantially constant diameter along its length. The diameter of the rods 26 and the spacing between adjacent rods 26 are at least approximately scaled with the radius of the spiral winding 12. In other words, a more radially outwardly disposed rod 26 in any respective plane has a greater diameter than that of a more radially inwardly disposed rod 26 in t he same respective plane. Also, the sp acing between more radially outwardly disposed adjacent pairs of rods 26 of any respective plane is greater than the spacing between more radially inwardly disposed adjacent pairs of rods 26 of the same respective plane. Thus, the spacing between rod A and rod B is greater than the spacing between rod B and rod C, and so forth towards the center of the solid dielectric substrate 22.

The quasi-periodic dielectric reflective backing 20 further includes a second array having a plurality of second elongated dielectric elements in the form of cones 28. The cones 28 are situated between adjacent planes of rods 26 of the first array. The cones 28 extend radially through the solid dielectric substrate 22, from the center of the solid dielectric substrate 22 to its circumference. The cones 28 have a diameter which increases in a radially outward direction through the dielectric substrate 22. The diameter of the cones 28 is at least approximately scaled with the radius of the spiral winding 12.

One or more cones 28 may be situated between adjacent planes of rods 26 of the second array. As shown in FIGS. 1 and 2, two cones are disposed in a sidewise, tiered arrangement axially through the solid dielectric substrate 22 to define upper and lower dielectric cones respectively residing in upper and lower planes extending radially through the solid dielectric substrate 22 and substantially orthogonally to the planes in which the dielectric rods 26 reside.

The quasi-periodic dielectric backing 20 further includes a third array having a plurality of third elongated dielectric elements in the form of rings 30. The rings 30 are arranged substantially concentrically to each other and reside in a plane extending through the solid dielectric substrate 22. The plane in which the rings 20 reside is substantially orthogonal to the planes in which the dielectric rods 26 of the first array reside.

Each ring 30 has a substantially constant diameter along its elongated length. However, the diameter of the rings 30 and the spacing between adjacent rings 30 are at least approximately scaled with the radius of the spiral winding 12. Stated differently, a more radially outwardly disposed ring 30, such as ring D, has a greater diameter than that of a more radially inwardly disposed ring, for example, ring E. Also, the spacing between more radially outwardly disposed adjacent pairs of rings 30, such as between rings D and E, is greater than the spacing between more radially inwardly disposed adjacent pairs of rings, such as rings F and G, as illustrated by FIG. 1.

Preferably, the quasi-periodic dielectric backing 20 includes upper and lower dielectric cones I, J respectively residing in upper and lower parallel planes, and the rings 30 are situated between the upper and lower cones. Any one concentric ring 30 is further preferably situated between a respective pair of adjacent dielectric rods 26 of each of the radially disposed planes in which the rods 26 reside. For example, as shown in FIG. 1, ring D resides between the upper cones I and lower cones J, and passes between rods A and B as well as the other outermost pair of dielectric rods 26 embedded in the solid dielectric substrate 22. Ring E, the next innermost concentric ring, passes between the upper and lower cones 28 as well as between rods B and C and the other rods 26 in other planes in a similar radial disposition with respect to rods B and C.

The radial scaling of the rods, cones and rings causes the band-stop properties of the composite structure to radially scale (i.e., the stop frequency increases with radius). Thus, the composite structure will exhibit a stop-band in the active region of the spiral winding 12 regardless of the operating frequency.

Preferably, the solid dielectric substrate 22 is formed from a ceramic commonly used for dielectric resonators. Such ceramics have a high dielectric constant and exhibit low losses. These parameters remain substantially stable with temperature. The dielectric constant is preferably chosen to be relatively high so that spacings in the periodic structure appear microscopic to the radiating spiral winding of antenna 12, yet are commensurate with the wavelength within the solid dielectric substrate 22 so that Bragg scattering is enhanced. Such ceramics include, but are not limited to, alumina and S8500, as described previously.

The elongated dielectric elements (i.e., the rods 26, cones 28 and rings 30) of the three mutually perpendicular arrays are formed of a lower dielectric-constant material, as mentioned previously. The quasi-periodic dielectric backing 20 is formed by adding the lower dielectric-constant rods 26, cones 28 and rings 30 to the higher-dielectric constant solid dielectric substrate 22 structure during the green state, that is, before sintering. It should be noted that cast dielectric materials may also be used in the formation of the solid dielectric substrate 22 and the embedded rods 26, cones 28 and rings 30. Although cast dielectric materials have a higher loss than that of sintered ceramics, such materials facilitate the fabrication and evaluation process.

The spiral winding 12 is affixed to one axial side of the reflective backing by preferably bonding with an adhesive or the like. The winding 12 may also be formed by etching it on copper clad kapton™ or Mylar™ material or their equivalent, and then bonding the etched material to an axial side of the reflective backing 20.

The high efficiency broadband antenna 10 of the present invention provides unidirectionality and frequency independence, as well as wide bandwidth and beamwidth found in conventional spiral antennas. The reflective backing 20 provides the antenna 10 with forward radiation as opposed to backward reflection or absorption, and increases the gain by 3 dB over conventional spiral antennas having absorber backings.

Figure 3:
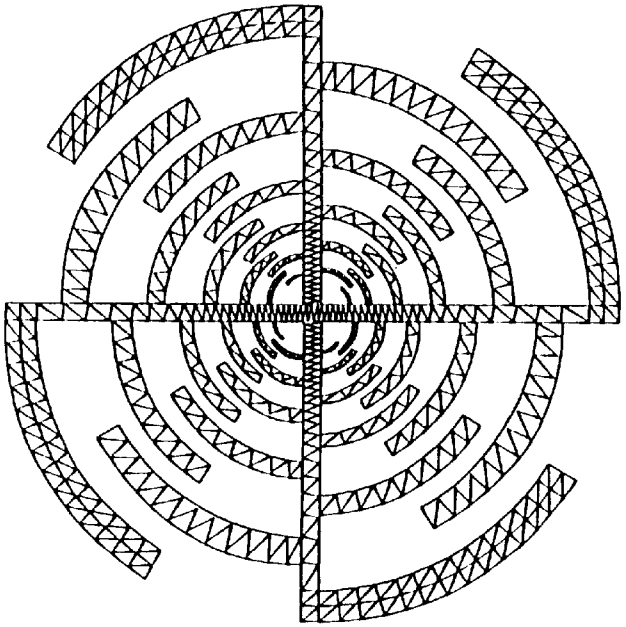
FIG. 3 is a log-periodic structure for use in the high efficiency broadband antenna of the present invention.

The planar spiral winding may be replaced with a planar log-periodic structure such as that shown in FIG. 3 and described in the following references, which are hereby incorporated by reference.

1. R. E. Franks and C. T. Elfving, *Reflector-Type Periodic Broadband Antennas,* 1958 IRE WESCON Convention Record, pp. 266–271.
2. D. A. Hofer, Dr. O. B. Kesler and L. L. Lovet, *A Compact Multi-Polarized Broadband Antenna,* 1990 IEEE Antennas & Propagation Symposium Digest, Vol. 1, pp. 522–525.

Figure 4:
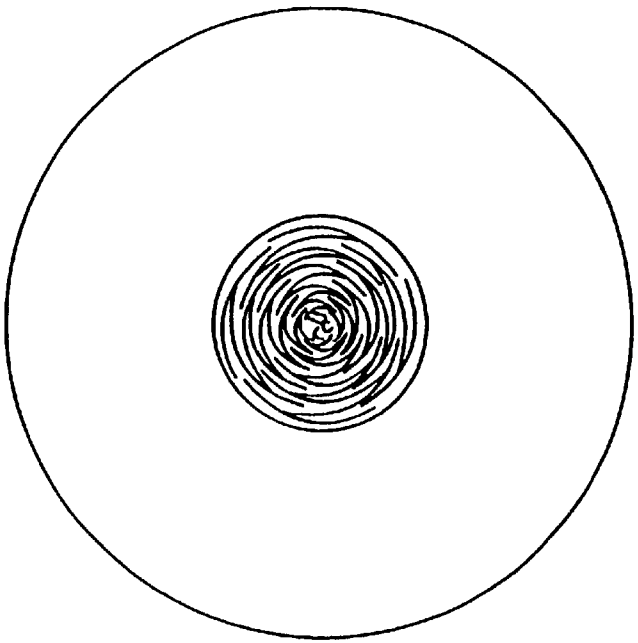
FIG. 4 is a sinuous structure for use in the high efficiency broadband antenna of the present invention.

Alternatively, the spiral winding may be replaced by a sinuous structure such as that shown in FIG. 4 and described in the following references, which are hereby incorporated by reference.

3. U.S. Pat. No. 4,658,262 to R. H. DuHamel.
4. V. K. Tripp and J. J. H. Wang, *The Sinuous Microstrip Antenna,* 1991 IEEE Antennas & Propagation Symposium Digest, Vol. 1, pp. 52–55.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An antenna, which comprises:

at least two substantially planar conductors cooperatingly arranged in a substantially planar configuration, the substantially planar configuration having a center and a radius associated therewith; and a reflective backing situated on an axial side of the substantially planar configuration, the reflective backing including a radially scaled, quasi-periodic dielectric structure, the radial scaling of the dielectric structure being in the direction of the radius of the substantially planar configuration, the quasi-periodic dielectric structure including a substantially solid dielectric substrate having a predetermined dielectric constant and a plurality of dielectric elements arranged adjacent to one another and being at least partially embedded in the solid dielectric substrate, the lateral cross-sectional dimensions of the plurality of dielectric elements increasing from the center of the substantially planar configuration radially outwardly therefrom, the plurality of dielectric elements having a predetermined dielectric constant which is less than the predetermined dielectric constant of the substantially solid dielectric substrate.

2. An antenna as defined by claim 1, wherein the reflective backing is photonic crystal-like in structure.

3. An antenna as defined by claim 1, wherein the quasi-periodic dielectric structure is formed from ceramic material.

4. An antenna as defined by claim 3, wherein the ceramic material includes alumina.

5. An antenna as defined by claim 1, wherein the dielectric constant of the substantially solid dielectric substrate is at least about 10.

6. An antenna as defined by claim 1, wherein the dielectric constant of the substantially solid dielectric substrate is about 38.

7. An antenna as defined by claim 1, wherein the dielectric constant of the plurality of dielectric elements is between about 1 and about 2.

8. An antenna as defined by claim 1, wherein the planar conductors forming the substantially planar configuration are etched on a copper clad material.

9. An antenna as defined by claim 8, wherein the copper clad material is affixed to the reflective backing.

10. An antenna as defined by claim 1, wherein the substantially planar configuration is a spiral winding structure.

11. An antenna as defined by claim 1, wherein the substantially planar configuration is a log-periodic structure.

12. An antenna as defined by claim 1, wherein the substantially planar configuration is a sinuous structure.

13. A method of making an antenna, which comprises the steps of:

forming a substantially planar configuration of at least two substantially planar conductors, the substantially planar configuration having a center and a radius associated therewith;

forming a reflective backing including a radially scaled, quasi-periodic dielectric structure, the radial scaling of the dielectric structure being in the direction of the radius of the substantially planar configuration, the quasi-periodic dielectric structure being formed by arranging a plurality of dielectric elements adjacent to one another and at least partially embedding the plurality of dielectric elements in a substantially solid dielectric substrate, the solid dielectric substrate having a predetermined dielectric constant, the lateral cross-sectional dimensions of the plurality of dielectric elements increasing from the center of the substantially planar configuration radially outwardly therefrom, the plurality of dielectric elements having a predetermined dielectric constant which is less than the predetermined dielectric constant of the substantially solid dielectric substrate; and affixing the substantially planar configuration to the substantially solid dielectric substrate.

14. A method of forming an antenna as defined by claim 13, wherein the step of forming the substantially planar configuration includes the step of etching the substantially planar configuration on a copper clad material.

15. A method of forming an antenna as defined by claim 14, wherein the step of affixing the substantially planar configuration to the solid dielectric substrate includes the step of bonding the copper clad material having the substantially planar configuration etched thereon to the solid dielectric substrate.

16. A method of forming an antenna as defined by claim 13, further comprising the step of sintering the dielectric substrate having the plurality of dielectric elements at least partially embedded therein.

17. A method of forming an antenna as defined by claim 13, further comprising the step of molding the dielectric substrate having the plurality of dielectric elements at least partially embedded therein.

18. A method of forming an antenna as defined by claim 13, wherein the step of forming a substantially planar configuration of at least two substantially planar conductors includes the step of forming a spiral winding structure from the at least two substantially planar conductors.

19. A method of forming an antenna as defined by claim 13, wherein the step of forming a substantially planar configuration of at least two substantially planar conductors includes the step of forming a log-periodic structure from the at least two substantially planar conductors.

20. A method of forming an antenna as defined by claim 13, wherein the step of forming a substantially planar configuration of at least two substantially planar conductors includes the step of forming a sinuous structure from the at least two substantially planar conductors.

* * * * *